United States Patent [19]

Shimba et al.

[11] Patent Number: 4,490,460

[45] Date of Patent: Dec. 25, 1984

[54] SILVER HALIDE COLOR PHOTOGRAPHIC MATERIALS

[75] Inventors: Satoru Shimba; Yoshikazu Watanabe; Kazuo Kato; Kiyotoshi Yamashita, all of Hino, Japan

[73] Assignee: Konishiroku Photo Industry Co., Ltd., Tokyo, Japan

[21] Appl. No.: 471,788

[22] Filed: Mar. 3, 1983

[30] Foreign Application Priority Data

Mar. 3, 1982 [JP] Japan ..... 57-34317

[51] Int. Cl.[3] ..... G03C 1/46

[52] U.S. Cl. ..... 430/504; 430/505; 430/507; 430/512; 430/523; 430/551; 430/554; 430/558

[58] Field of Search ..... 430/551, 554, 558, 507, 430/512, 523, 505, 504

[56] References Cited

U.S. PATENT DOCUMENTS

| | | | |
|---|---|---|---|
| 2,895,827 | 7/1959 | Callear et al. | 430/531 |
| 3,652,278 | 3/1972 | Asano et al. | 430/608 |
| 3,811,891 | 5/1974 | Darlak et al. | 430/609 |
| 3,844,794 | 10/1974 | Gandino et al. | 430/554 |
| 4,243,747 | 1/1981 | Nakamura et al. | 430/554 |
| 4,411,987 | 10/1983 | Kobayashi et al. | 430/554 |

*Primary Examiner*—J. Travis Brown

*Attorney, Agent, or Firm*—Frishauf, Holtz, Goodman & Woodward

[57] ABSTRACT

A silver halide color photographic material in which the photographic characteristics do not deteriorate when contacted with formaldehyde.

35 Claims, No Drawings

SILVER HALIDE COLOR PHOTOGRAPHIC MATERIALS

The present invention relates to a novel silver halide photographic material, and more particularly to a silver halide color photographic material in which the photographic characteristics do not deteriorate when contacted with formaldehyde.

BACKGROUND OF THE INVENTION

Commonly used materials, such as artificial building materials, furniture, plastic products, adhesives, clothing and the like, generate formaldehyde gas which adversely affects graphic material.

Generally speaking, a coupler in emulsion type silver halide color photographic material customarily comprises a support and a plurality of silver halide emulsion layers each having sensitivity to respectively a different spectral range and containing a coupler for forming a dye when the coupler reacts with a product oxidized with a color developing agent on said support. For example, silver halide emulsion layers normally which are sensitive to blue, green and red light and contain yellow, magenta and cyan couplers in respective layers.

After image exposure, each of the silver halide emulsion layers is then color-developed to form a yellow, magenta and cyan dye image thereon, respectively.

In such a multi-layered color photographic material, an excellent color-image can be obtained only when sensitivity and contrast are well-balanced between the above-mentioned silver halide emulsion layer. It is therefore desired that the photographic characteristics of such a multi-layered color photographic material does not change even after long preservation including the periods before and after exposure up to the time of development. If a coupler in an emulsion type silver halide color photographic material is in an atmosphere containing formaldehyde before it is colordeveloped, the coupler reacts with formaldehyde and is consumed and produces an undesirable reaction product. Consequently, this results in serious deterioration of photographic characteristics, such as lowering color density or gamma, a color stain, and increased fog.

To prevent photographic characteristics from deteriorating by reaction with formaldehyde, which is referred to herein as a toxic gas, it has been proposed to use a compound which makes formaldehyde non-toxic by reacting therewith (hereinafter referred to as an aldehyde scavenger). U.S. Pat. No. 2,309,492 discloses that a very small amount of formaldehyde produces a yellowish product through the action to a pyrazolone coloring agent and causes color-fog in a photographic element, and proposed to use an aldehyde scavenger such as hydroxylamine, a hydrazine derivative, a hydrazo derivative, semicarbazide, dimethylhydroresorcine or naphthylenediamine.

U.S. Pat. No. 2,895,827 discloses the problem that formaldehyde is produced from the support of a printing paper coated with an aldehyde resin such as urea-formaldehyde or malamineformaldehyde, and proposes an urea- or melamine-sizing layer on the surface of the support to serve as an aldehyde-scavenger.

U.S. Pat. No. 3,652,278 discloses a variety of compounds containing an amine or amide such as N,N'-ethylene urea, acetamide, N,N'-diacetyl ethylenediamine, monomethylamine, or dimethylamine, to serve as a scavenger for formaldehyde gas in the air.

Japanese Patent Examined Publication No. 34675/1971 proposes N,N-ethylene urea, 2,3-dihydroxynaphthalene, dimedone, and the like, for the similar purpose.

U.S. Pat. No. 3,811,891 and Japanese Patent Examined Publication No. 23908/1976, for example, also propose many types of scavengers for aldehyde.

From studies made by the present inventors, although there are some differences of the capability for scavenging aldehyde among most of the above-mentioned scavengers, all of the scavengers displayed almost similar scavenging capability. It is therefore obvious that the above-mentioned scavengers should be added in large quantity so that the photographic characteristics under discussion will be at a satisfactory level. However, as is well-known in the art, it is not possible to add a great quantity of an aldehyde scavenger because such aldehyde scavengers have the disadvantage that the physical properties of the photographic emulsion layer are deteriorated. For example, coating firmness becomes substantially weaker and the photographic characteristics thereof are also affected. However, when the amount of the aldehyde scavenger is such so as to not seriously deteriorate the physical properties of the photographic material and to not lower the photosensitivity and other photographic characteristics, the amount is insufficient to prevent deterioration of the photographic characteristics by formaldehyde.

In the meantime, with respect to the relation between the above-mentioned toxic gas and couplers, it has been confirmed that photographic characteristics are lowered by a toxic gas regardless of the kind of coupler which is used. In particular, the influence of such toxic gas in serious when using the so-called "Four-equivalent coupler" in which a substituted group is introduced on the active site of the molecules and is apt to be relatively more serious in the case of a yellow and magenta coupler than in the case of a cyan coupler, and inter alia, the magneta couplers are most seriously affected.

The present inventors have studied how formaldehyde gas reacts with the 5-pyrazolone-four-equivalent coupler that is the most polular magenta coupler, and have been unable to find any coupler capable of greatly preventing deterioration of photographic characteristics. It has also been known that the bad influence of toxic gases such as formaldehyde gas are diminished by increasing the relative amount of a hydrophobic and high boiling point organic solvent to that of the lipophilic coupler. Although this is an improvement, the results are still unsatisfactory. This sometimes causes undesired changes such as a physical property change of the coated layer when the relative amount of the high boiling point organic solvent is increased. The permissible relative increase in the amount of said solvent is therefore limited.

There have recently been reported various types of magenta couplers, which are less reactive with a toxic gas such as formaldehyde gas. Such magenta couplers have strong resistance against such gases. For example, in U.S. Pat. No. 3,214,437, 3,253,924, 3,311,476, 3,419,391, 3,617,291, 3,926,631, 3,522,052 and 3,227,554; Japanese Patent O.P.I. Publication No. 126833/1981; etc., disclose two-equivalent couplers as examples of such couplers.

When using such two-equivalent couplers, there are many cases in which, for example, (i) color-fog is seriously caused, (ii) reaction activity is not proper or (iii) the couplers are chemically unstable, so that the couplers become a substance incapable of developing color with the passage of time, and there is further such an inconvenient facet as the difficulty in synthesizing the couplers. The actual situation is therefore that no satisfactory coupler is known.

It is an object of the invention to provide a silver halide color photographic material whose photographic characteristics do not deteriorate with resultant lowering of color density or gamma, occurrence of a color stain or increase in fog, even when the photographic material is exposed to a toxic gas such as formaldehyde gas for a long time until it is finally color-developed.

Another object of the invention is to provide a silver halide color photographic material in which the formaldehyde substance is improved and deterioration of the physical properties of the coated layers and the photographic characteristics do not occur.

THE INVENTION

The present inventors have achieved these objects by providing a silver halide color photographic material comprising a support having thereon at least one layer containing magenta couplers of the formula I, and containing at least one of the compounds having the respective formulas, [IIA], [IIB], [IIC] and [IID], in (1) the layer containing the magenta couplers, or when there is a photographically constituent (element) layer on the layer containing the magenta couplers in the direction opposite the support, the compound is contained in at least one of the layers containing magenta couplers and/or one of said photographic element layers:

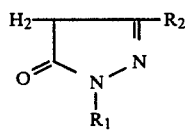

Formula [I]

wherein, $R_1$ represents an aryl group or a heterocyclic group; and $R_2$ represents a benzamide group, anilino group or phenylureido group which contains an

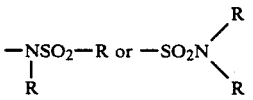

group wherein R represents a hydrogen atom, an alkyl group, an aryl group, an alkoxy group, an amino group or heterocyclic group.

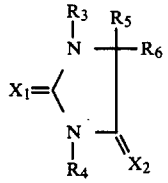

Formula [IIA]

wherein $X_1$ and $X_2$ each represent oxygen or an imino group; $R_3$ and $R_4$ each represent hydrogen, an acyl group such as alkylcarbonyl and arylcarbonyl or an alkyl group; and $R_5$ and $R_6$ each represent hydrogen, a hydroxyl group, an amino group, a ureido group, an alkyl group, an aryl group, an aryloxy group, or an alkoxy group and $R_5$ and $R_6$ may be coupled to produce a 5–6 membered saturated carbocyclic nucleus.

The preferred alkylcarbonyl, alkyl and alkoxy group are those containing from 1 to 5 carbon atoms. The preferred 5–6 membered saturated carbocyclic nucleus are cyclopentyl or cyclohexyl. The preferred aryl groups (including arylcarbonyl), are phenyl and naphthyl with phenyl being particularly preferred. Compounds in which oxygen is $X_1$ and $X_2$, hydrogen is $R_3$ and $R_4$, and hydrogen or the ureido group is $R_5$ and $R_6$, are the most preferred.

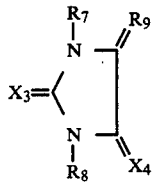

Formula [IIB]

wherein, $X_3$ and $X_4$ each represent oxygen or an imino group; $R_7$ and $R_8$ each represent hydrogen, an acyl group such as alkylcarbonyl and arylcarbonyl, or an alkyl group; and $R_9$ represents an imino group or an alkylidene group.

The preferred alkyl groups (including alkylcarbonyl and alkylidene) contain from 1 to 5 carbon atoms. Compounds in which $R_7$ and $R_8$ are hydrogen are the most preferred. The preferred aryl groups (including arylcarbonyl) are phenyl and naphthyl with phenyl being particularly preferred.

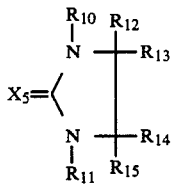

Formula [IIC]

wherein $X_5$ represents oxygen or an imino group; $R_{10}$ and $R_{11}$ each represent hydrogen, an acyl group such as alkylcarbonyl and arylcarbonyl or an alkyl group; and $R_{12}$, $R_{13}$, $R_{14}$ and $R_{15}$ each represent hydrogen, a hydroxy group, an amino group, an alkyl group, an alkoxy group, an aryl group, an aryloxy group, a ureido group, and $R_{12}$ and $R_{13}$ and $R_{14}$ and $R_{15}$ can be coupled to form a 5–6 membered saturated carbocyclic nucleus.

Compounds in which alkyl (including alkylcarbonyl) and alkoxy groups contain from 1 to 5 carbon atoms are preferred. The preferred aryl (including arylcarbonyl and aryloxy) groups are phenyl and naphthyl and more preferably is phenyl. The preferred 5–6 membered saturated carbocyclic nucleus is cyclopentyl or cyclohexyl.

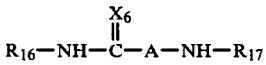

Formula [IID]

wherein $X_6$ represents oxygen or an imino group; $R_{16}$ and $R_{17}$ each represent hydrogen, an alkyl group or an aryl group; and A represents $—NH(CH_2)_m—NHCO—$ or —NHCO— in which the terminal nitrogen atom couples to the carbon atom bonded to the $X_6$ group and m is 1 or 2. The preferred alkyl group contains 1 to 5 carbon atoms. The preferred aryl group is a phenyl group.

The substituting groups discussed hereinafter which can be substituted on $R_1$ can generally also be substituted on $R_2$–$R_{22}$ and R. However, when R and $R_2$–$R_{22}$ are substituted, the following substituents are preferred: halogen, hydroxy, nitro, cyano, carboxyl, alkyl, aryl, acyl, alkylsulfonyl, arylsulfonyl and a heterocyclic ring group selected from pyridyl, quinolyl, furyl, benzothiazolyl, oxazolyl, imidazolyl, and naphthoxyazolyl. When such substituting groups contain alkyl, aryl or acyl, said alkyl, aryl and acyl are preferably those specified herein in the definitions of the compounds of Formula I, IIA, IIB, IIC and IID as being preferred.

Referring now in more detail to the invention, the effects of the invention cannot be obtained unless the aforespecified magenta couplers and the formaldehyde scaventers are specifically combined.

Referring first in more detail to the aforegiven formulas; as for the concrete examples of an aryl group represented by $R_1$ in Formula [I], they are given as phenyl group and naphthyl group; and as for the examples of a heterocyclic group represented by $R_1$ in the formula, they are given as pyridyl group, quinolyl group, furyl group, benzothiazoyl group, oxazolyl group, imidazolyl group, and naphthoxazolyl group. The above-given groups include those into which at least one of the following substituents is introduced and those into which at least one substituent is substituted once again by one of the aforegiven groups. The substituents are halogen, nitro, cyano, amino, hydroxy and aryloxy groups and those of an alkyl, aralkyl, alkenyl, aryl, alkoxy, ester, carbonyl, sulfamoyl, carbamoyl, ureido, hererocyclic ring, sulfonyloxy, oxo, acylamino, carboxyl, sulfonamide, alkylthio, and arylthio groups and the like. Particularly in the invention, a phenyl group into which at least one of the groups in the ortho position thereof is substituted by an alkyl group preferably containing 1–4 carbon atoms, an alkoxy group preferably containing 1–4 carbon atoms, halogen such as chlorine and bromine or the like are used with advantage to serve as the abovementioned $R_1$.

Preferred magenta couplers include those respectively having the Formulas [IIIA] and [IIIB] below:

Formula [IIIA]

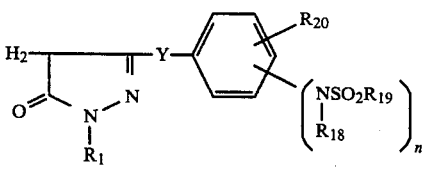

Formula [IIIB]

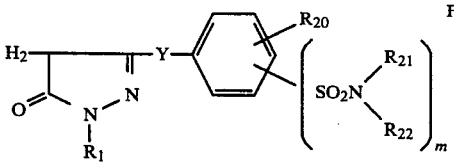

wherein, $R_1$ represents the same groups as represented by $R_1$ in Formula [I]; Y represents —NHCO— group, —NH— group or —NHCONH— group; and $R_{18}$, $R_{21}$ and $R_{22}$ each represent hydrogen, an alkyl, aryl, or heterocyclic group having from 1 to 18 carbon atoms which is, for example, the same one as represented by the abovementioned $R_1$. $R_{19}$ represents an alkyl or aryl group having from 1 to 18 carbon atoms which is, for example, the same one as represented by $R_1$, an alkoxy group having from 1 to 18 carbon atoms or an amino group which can be, for example, substituted with an alkyl or aryl group having from 1 to 18 carbon atoms; $R_{20}$ represents hydrogen, halogen, or an alkoxy group having from 1 to 4 carbon atoms; and n and m represent 1 or 2, respectively.

Preferred aryl groups are a phenyl group substituted with an alkoxy group having from 1 to 18 carbon atoms, an amino group having from 1 to 18 atoms or an alkyl group having from 1 to 18 carbon atoms.

It is preferable in the invention that the abovementioned Y represents —NHCO— group or —NH— group. When Y is —NHCO— group, that is, $R_2$ in the abovementioned Formula [I] is a benzamide group having sulfonamide group, then $R_{20}$ in Formulas [IIIA] and [IIIB] each is preferably hydrogen. When Y is the —NH— group, that is, $R_2$ represented in Formula [I] is anilino group having sulfonamide group, then $R_{20}$ represented in the Formulas [IIIA] and [IIIB] each is preferably halogen or an alkoxy group.

The following are the examples of magenta couplers useful in the invention, however, the invention shall not be limited thereto.

M-1

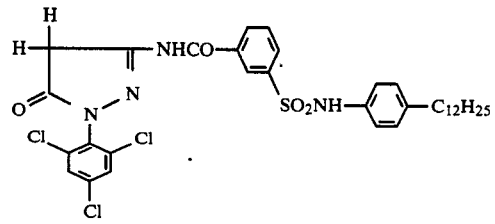

M-2

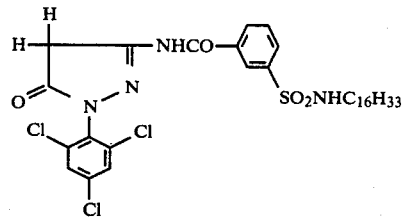

M-3

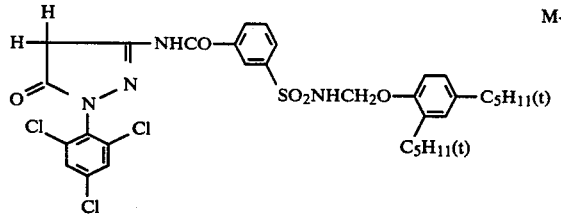

M-4

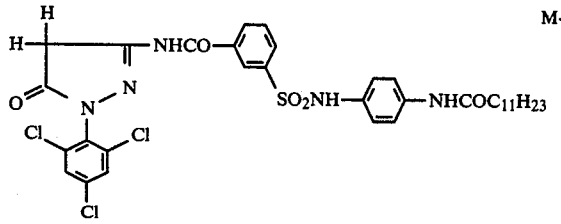

-continued
M-5
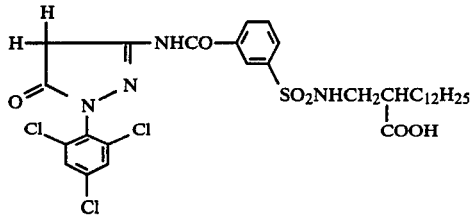
M-6
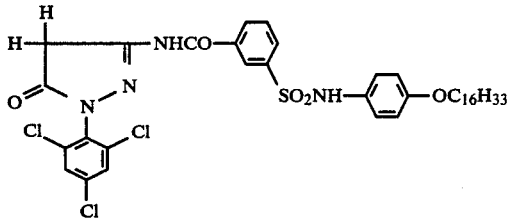
M-7
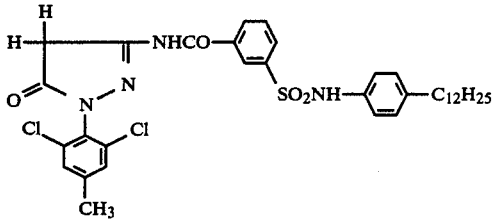
M-8
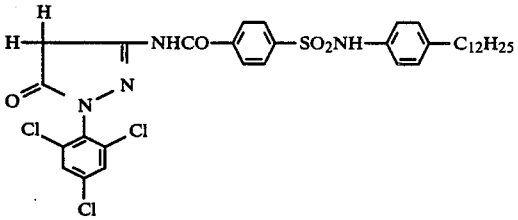
M-9
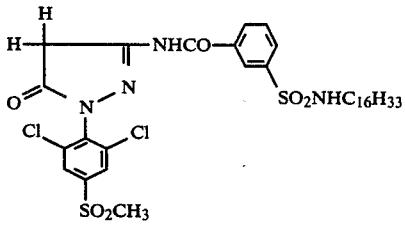
M-10
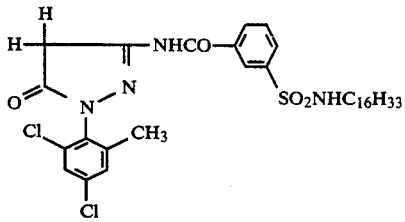
M-11
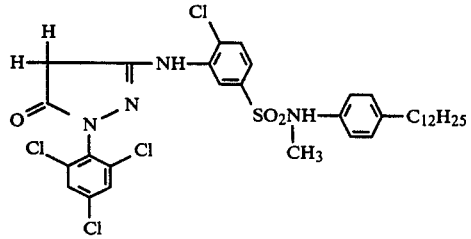
-continued
M-12
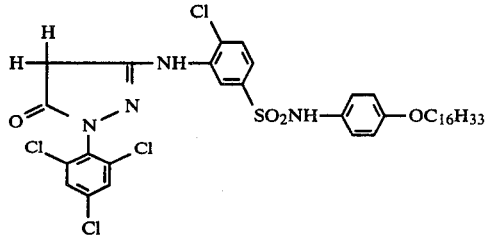
M-13
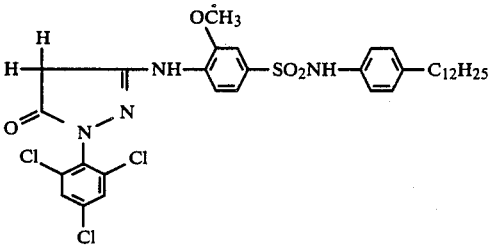
M-14
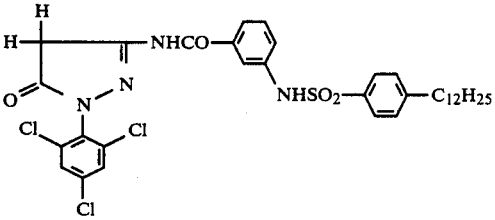
M-15
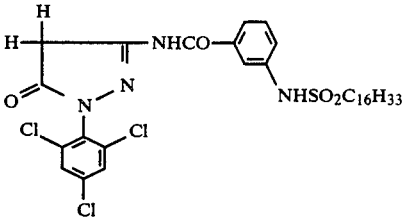
M-16
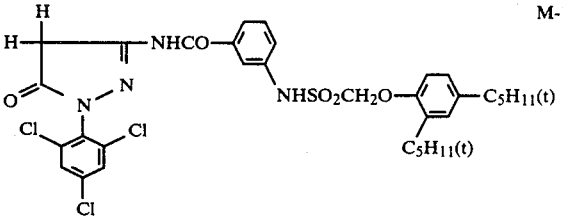
M-17
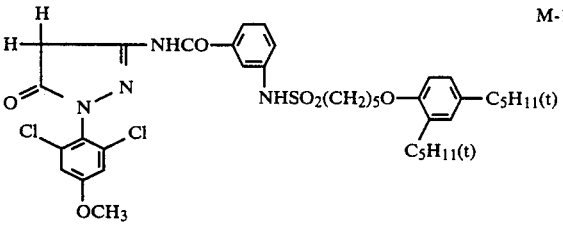
M-18
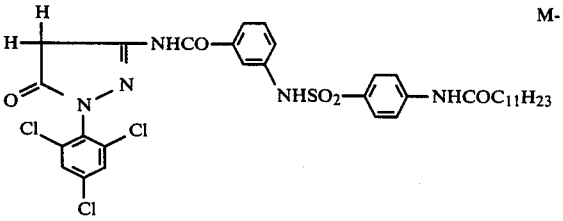

-continued
M-19
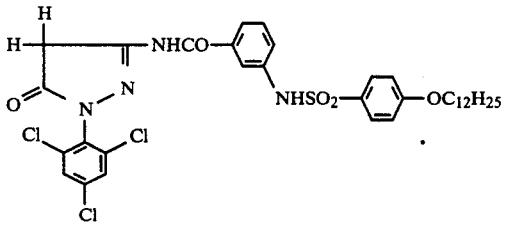
M-20
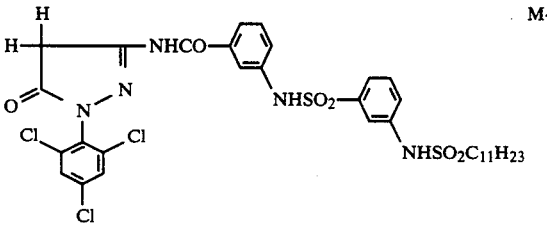
M-21
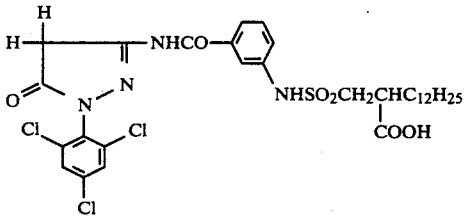
M-22
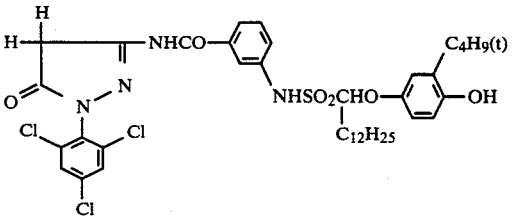
M-23
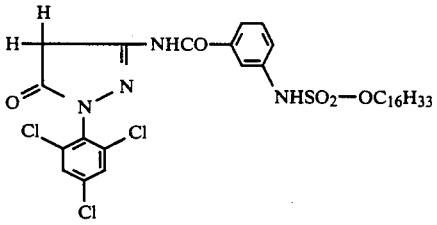
M-24
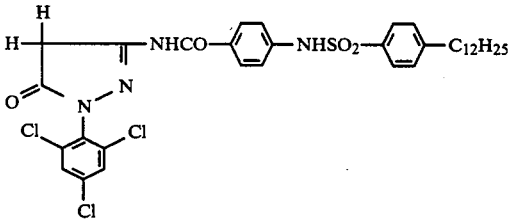
M-25
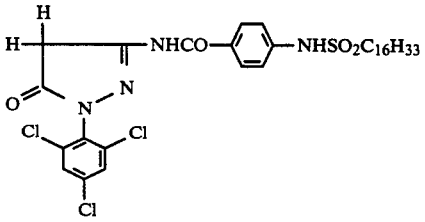
-continued
M-26
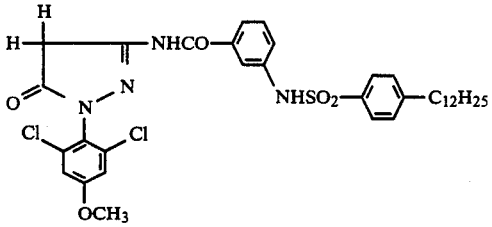
M-27
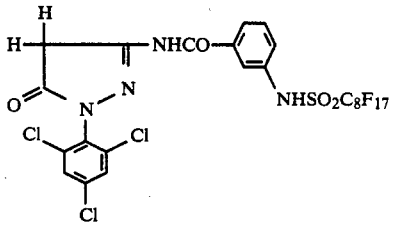
M-28
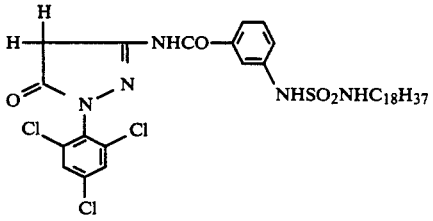
M-29
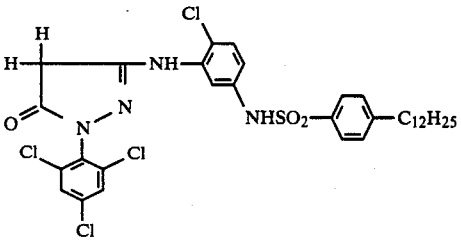
M-30
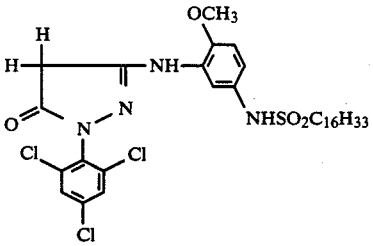
M-31
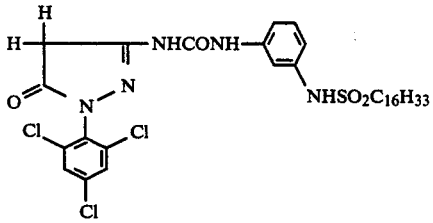
M-32
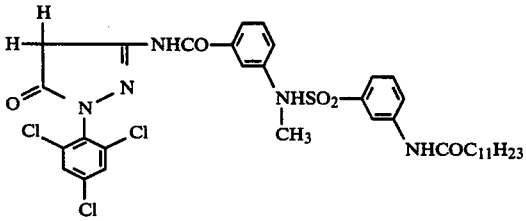

-continued
M-33
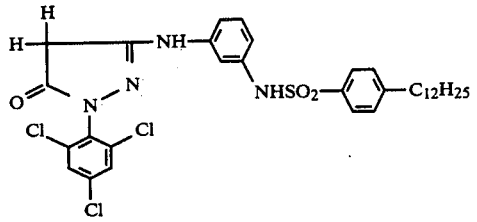
M-34
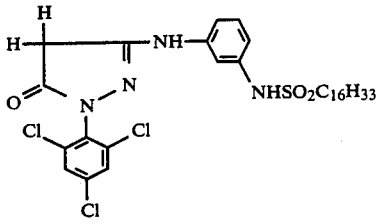
M-35
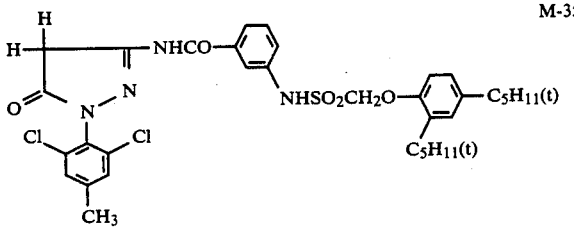
M-36
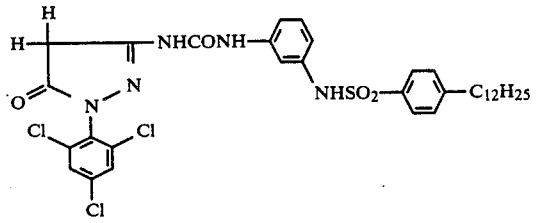
M-37
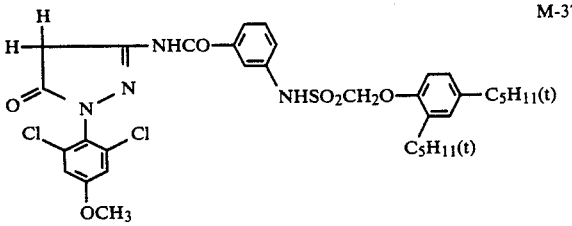
M-38
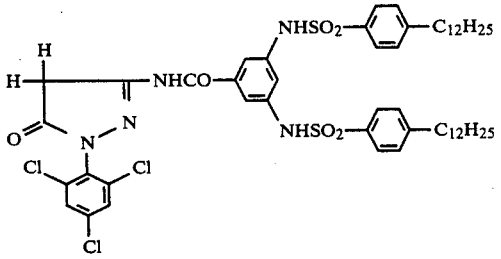
-continued
M-39
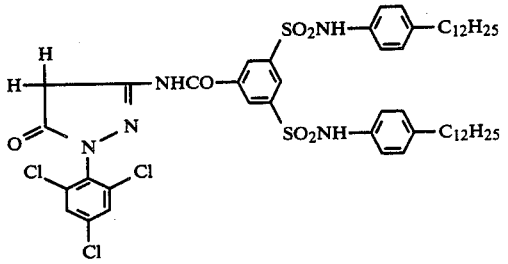
M-40
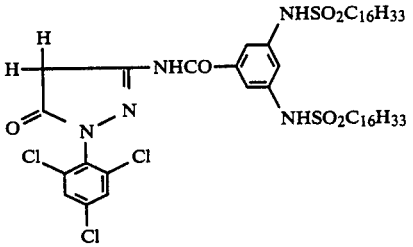
M-41
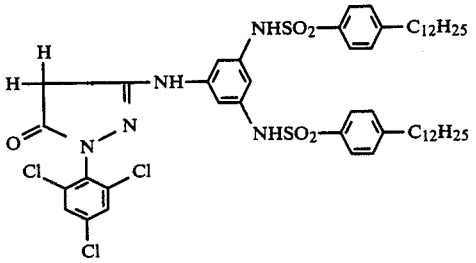
M-42
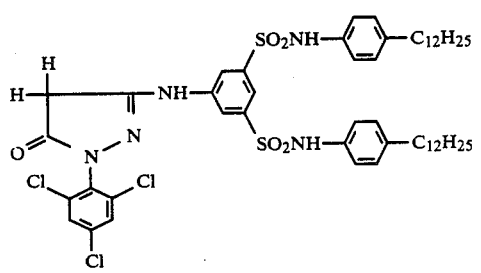
M-43
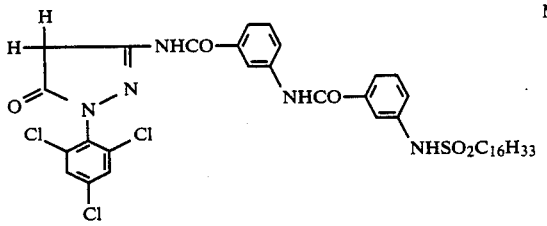
M-44
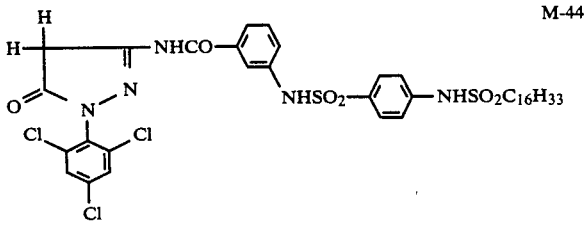

-continued
M-45
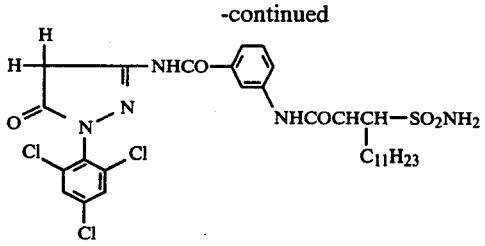
M-46
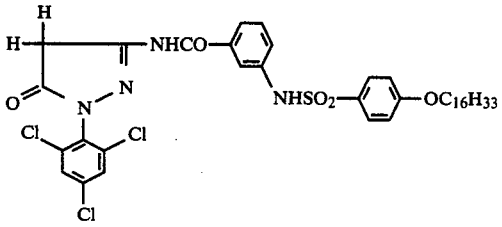
M-47
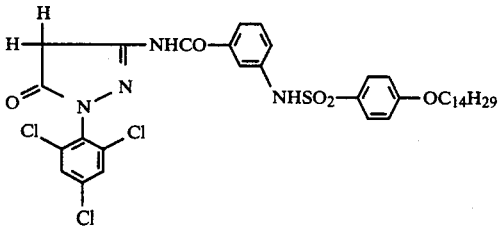
M-48
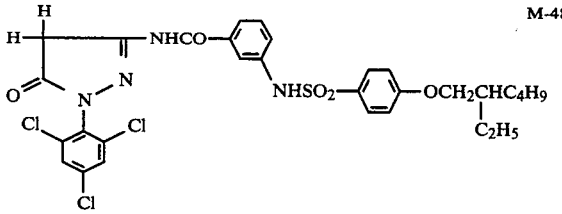
M-49
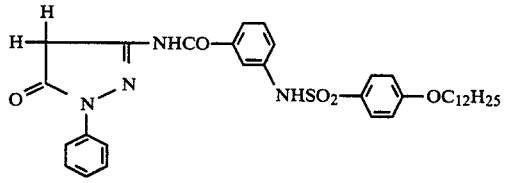
M-50
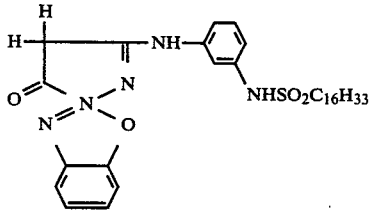
M-51
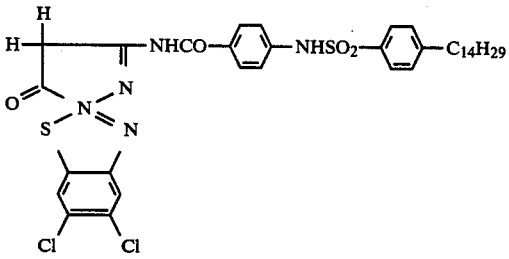
Next, the following are the examples of the formaldehyde scavengers relating to the invention, formulated respectively by the abovementioned Formulas [IIA] through [IIB], however, the invention shall not be limited thereto.
[Exemplified Formaldehyde Scavengers]
(1)
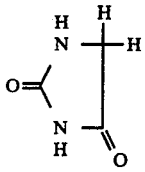
(2)
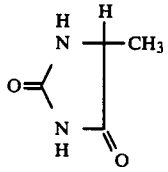
(3)
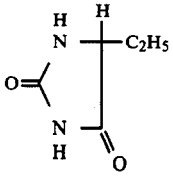
(4)
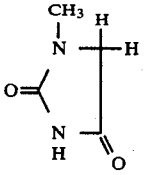
(5)
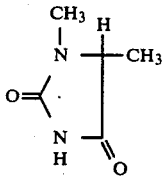
(6)
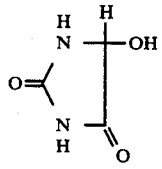
(7)
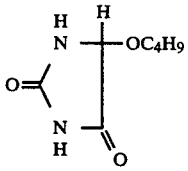
(8)
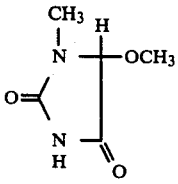

-continued
(9)
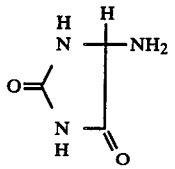
(10)
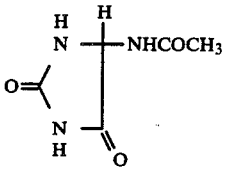
(11)
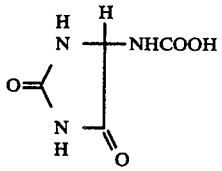
(12)
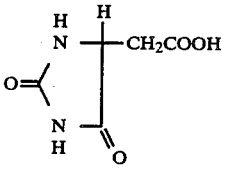
(13)
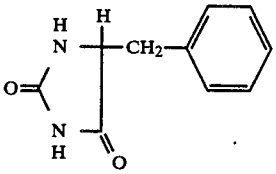
(14)
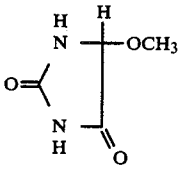
(15)
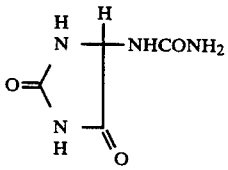
(16)
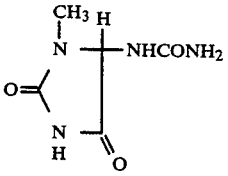
(17)
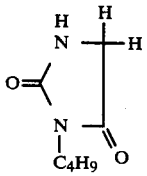
-continued
(18)
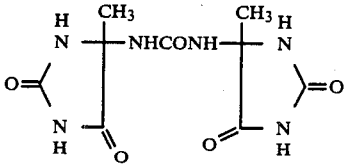
(19)
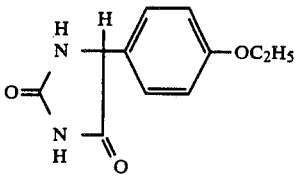
(20)
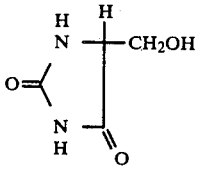
(21)
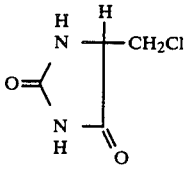
(22)
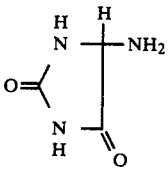
(23)
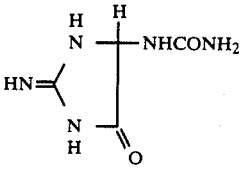
(24)
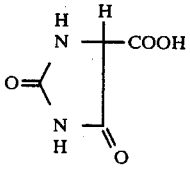
(25)
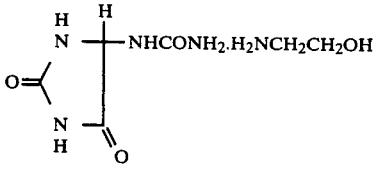
(26)
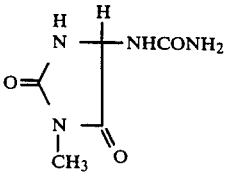

-continued
(27)
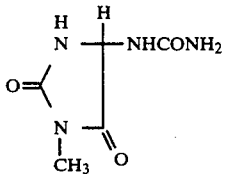
(28)
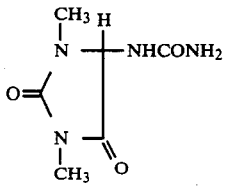
(29)
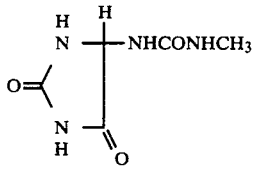
(30)
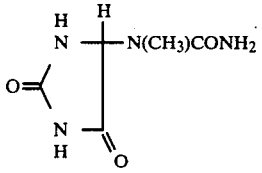
(31)
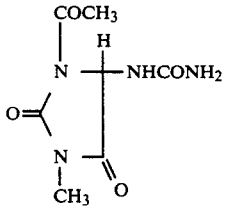
(32)
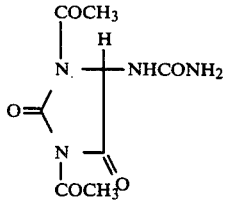
(33)
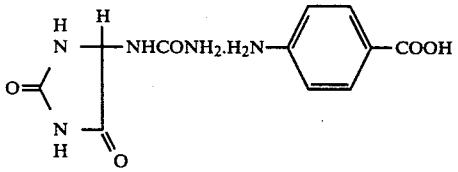
(34)
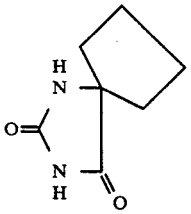
-continued
(35)
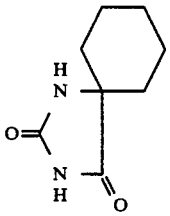
(36)
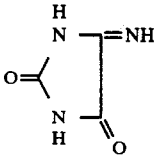
(37)
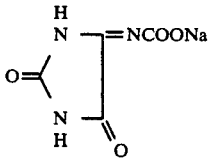
(38)
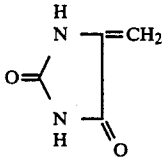
(39)
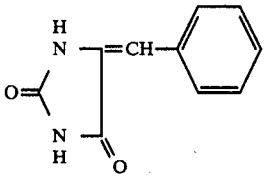
(40)
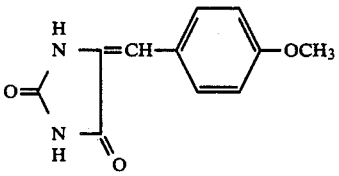
(41)
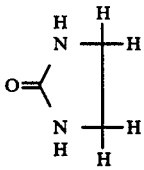
(42)
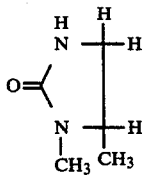

-continued

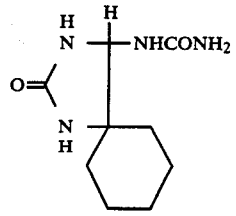

(43)

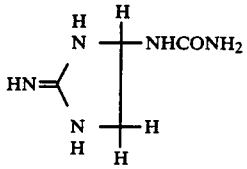

(44)

$H_2NCONHCH_2CH_2NHCONH_2$ (45)

$CH_3—NHCONHCH_2CH_2NHCONH_2$ (46)

$H_2NCONHCH_2NHCONH_2$ (47)

These compounds may be easily synthesized in accordance with such a process as described in the Bulletin of the Chemical Society of Japan, pp. 1559–1567, pp. 1734–1738 (1966), Chemische Berichte, vol. 54B, pp. 1802–1833, 2441–2479 (1921) and the like.

In the case that the magenta couplers and the formaldehyde scavengers relating to the invention, which are formularized in the aforesaid Formulas, are respectively and independently used, then their effects are similar to the conventional couplers and scavengers. For example, the abovementioned formaldehyde scavengers have the capability of scavenging formaldehyde only equivalent to those of the conventionally well-known scavengers if the former are added independently so as not to affect the physical properties and the photographic characteristics of a photographic material. On the other hand, the aforementioned magenta couplers have very little resistance against a toxic gas such as formaldehyde gas in comparison with the conventional four-equivalent magenta couplers, if the former is used under the different conditions from those of the invention.

Accordingly, the effects of the invention can be attained only when aforedescribed aldehyde scavengers of this invention and an aforedescribed four-equivalent magenta coupler are used together.

Particularly, the effects of the invention are so unique that, even if the silver halide color photographic material of the invention should contact with a toxic gas such as an aldehyde gas for a long period of time and is then stored under conditions of high temperature and humidity, its photographic characteristics are not seriously worsened. In the photographic material of the invention, not only are the photographic characteristics not worsened, but the physical properties of the layers are not lowered.

There have been problems in the processing stability of a magenta coupler having the sulfonamide group in the third position, as shown in the aforegiven Formulas [IIIA] and [IIIB] which are preferably used in this invention, and particularly, such magenta couplers are apt to be affected by the pH and the activity of a developing liquid, such as temperature variation, or the concentration of bromine ions of a development inhibitor which is eluted from a photographic material and is then accumulated in the developing liquid.

The above-mentioned defects are improved by the combining magenta coupler having the above-mentioned sulfonamide group with an aldehyde scavenger, and consequently excellently stable processing can be performed, and particularly the fog-inhibition property is greatly improved when processing under conditions of high temperature and high pH.

Although the effects of the invention are very unique, every combination of the aforedescribed magenta couplers and aldehyde scavengers can be used in the invention. In particular, in order to attain the effect of improving processing stability as described above, it is most preferred to make a combination use of a magenta coupler containing a sulfonamide group, such as those designated by Formulas [IIIA] and [IIIB] out of those designated by Formula [I] and an aldehyde scavenger designated by Formulas [IIA] and [IIB].

In a silver halide color photographic material in which photographic element layers are arranged over the layer containing magenta couplers, the aldehyde scavengers relating to the invention may be contained independently and in combination of two or more kinds thereof into at least one layer of the layers each containing magenta couplers and/or the photographic element layers arranged over the layers containing magenta couplers. The most preferable layer into which the aldehyde scavengers are included is the layer that is the nearest to the air, e.g., the protective layer, is effective for this purpose.

In the invention, the aforementioned photographic element layers include not only light-sensitive silver halide emulsion layers which are, for example, optically or chemically sensitized to form a photosensitive material, but also auxiliary layers which are the non-light-sensitive layers such as an intermediate layer, ultra-violet absorbing layer, yellow filter layer, protective layer and the like.

To add and contain the formaldehyde scavengers relating to the invention into the above-mentioned layers, the scavengers may be dissolved in water or an appropriate solvent such as methanol and may then be added to coating liquid for forming the layer, and the scavengers may be added at any time and in any step. For instance, in the case of adding them to a silver halide emulsion, they may be added at any time in the emulsion preparing processes, but generally speaking, it is desirable to add immediately before an emulsion coating process.

The amount such scavengers is from no less than about 0.1 g to 5 g per sq meter of the color photographic material, and particularly the most effective result is attained when 0.1–2 g thereof are added.

A variety of methods for dispersing the magenta couplers relating to the invention may be used such as the so-called alkaline aqueous solution dispersion method, an oil drop-in-water type emulsification dispersion method and the like.

Inter alia, as for the oil drop-ink-water type dispersion methods, a conventional known dispersion method for conventionally dispersing a hydrophobic compund such as a coupler for photographic use can be used. For example, the above-mentioned hydrophobic compound is dissolved in an organic solvent having a high boiling point of no lower than 175° C., such as dibutyl phthalate, triphenyl phosphate, tricresyl phosphate and the like, or an organic solvent having a relatively lower boiling point, such as ethyl acetate, methanol, acetone, dioxane and the like, independently or in combination, and the thus obtained solution is mixed with an aqueous gelatin solution containing a surface active agent. Then the mixture is emulsifiably dispersed by a high-speed rotary mixer or a colloid mill, and the thus emulsified dispersion product is added directly into a silver halide emulsion; or the above-mentioned emulsified dispersion solution is set and cut into small pieces, and organic solvent having a relatively lower boiling point is removed by, for example, washing, and the material thus obtained may be added to a silver halide emulsion.

The aforedescribed magenta couplers used in the invention may be used in combination with, for example, the following:

1. A magenta coupler as disclosed in: U.S. Pat. Nos. 2,439,098, 2,369,489, 2,600,788, 2,558,319, 2,311,081, 3,419,391, 3,214,437, 3,006,759, 2,725,292, 3,519,429, 3,615,506, 3,062,653, 3,582,322, 2,801,171, 3,311,476, B.P. No. 956,261, Japanese Patent O.P.I. Publication Nos. 74027/1974, 13041/1975, 131448/1974, 111631/1974, 60233/1975, 74028/1974.
2. A magenta colored coupler as disclosed in U.S. Pat. Nos. 2,983,608, 2,455,170, 2,725,292, 3,005,712 3,519,429, 2,688,539, B.P. Nos. 800,262, 1,044,778, 1,464,361, 1,443,875, Belgian Patent No. 676,691 W. German OLS Patent No. 2,643,965.
3. A so-called DIR coupler releasing a compound for inhibiting the process of a development imagewise in a developing process, such as a monothio type coupler disclosed in: U.S. Pat. Nos. 3,227,550, 3,938,996 3,227,554, 4,010,035, B.P. No. 953,454, an o-aminophenylazo type coupler disclosed in: U.S. Pat. No. 3,148,062, a coupler disclosed in: Japanese Patent Examined Publication No. 8750/1972.
4. A compound selected from the hydroquinone groups each releasing a compound for inhibiting development progress in a developing process, as disclosed in: U.S. Pat. No. 3,297,445, B.P. No. 1,058,606.

The above given couplers may also be used jointly with no less than two kinds thereof in one and the same layer in order to satisfy the requirements of the characteristics of a photographic material. It is also possible to add the same kind of compound into no less than two different layers. The amount added of the abovementioned couplers relating to the invention is at the rate of $5\times10^{-3}$ mol-5 mol per mol of silver halide, and more desirably, in the order of $1\times10^{-2}$ mol-1 mol.

The silver halide color photographic materials of the invention may be used in combination with the couplers for forming the other color dye images such as a yellow coupler, cyan coupler and the like, and may also be used together with a variety of the photographic additives.

The yellow couplers which are preferably used in combination, includes a benzoyl acetanilide type yellow coupler, a pivaloyl acetanilide type yellow coupler, and a two-equivalent type yellow coupler in which the carbon atom in the coupling position is substituted by a substituted group that is releasable at the time of the coupling reaction.

The cyan couplers which are preferably used in combination therewith, phenol derivatives or naphthol derivatives are examples. Examples of the colored cyan couplers are compounds in which an arylazo substitution is made in the coupling position of a colorless cyan coupler, and the colored cyan couplers in which the color dyes thereof flow into a processing liquid as a result of reaction with the oxidants of a color developing agent.

In the silver halide color photographic material of the invention, hydrophilic colloids which are advantageously usable for preparing a photosensitive emulsion include galatin; a gelatin derivative such as phenylcarbamyl-gelatin, amyl-gelatin, phthalic-gelatin or the like; colloidal albumin; agar; gum arabic; a cellulose derivative such as hydrolysed cellulose acetate, carboxymethyl cellulose, hydroxyethyl cellulose, methyl cellulose or the like; acrylamide; imidic polyacrylamide; casein; a vinyl alcohol polymer containing a urethanecarboxylic acid group or a cyanacetyl group, such as vinyl alcohol-vinyl cyano acetate copolymer; polyvinyl alcohol; polyvinyl ryrolidone; hydrolysed polyvinyl acetate; a polymer obtainable by polymerizing protein or saturated acyl-protein with a monomer having a vinyl group; or the like. A silver halide usable in a photosensitive emulsion includes those which are commonly used in silver halide photographic emulsions, such as silver bromide, silver chloride, silver iodobromide, silver chlorobromide, silver chloroiodobromide, or the like.

The silver halide emulsions used in the invention may be prepared in not only a popular process but also a variety of other processes. The above-mentioned silver halide emulsions may be sensitized by the conventional types of chemical sensitizers. If the occasion arises, a spectral sensitization or a forced color sensitization is also possible by using independently or in combination cyanine dyes such as cyanine, merocyanine, carbocyanine and the like, or by using styryl dyes combined with the above cyanine dyes.

For the purpose of stabilizing the sensitivity and fogginess, it is possible to add to the above-mentioned silver halide emulsion, a stabilizer or anti-foggant such as 1-phenyl-t-mercaptotetrazole, 4-hydroxy-6-methyl-1,3,3a,7-tetrazaindene, or the like.

The hardening agents for photographic use which may be added to the above-mentioned silver halide emulsion, include, for example, an organic or inorganic hardening agent such as compounds of a methane sulfonic acid ester, a mucochromic acid or a mucohalogeno acid; an epoxy compound; an azylidine compound; a maleic acid imide compound; an N-methylol compound; an isocyanate compound; or a zirconium sulfate.

A surface active agent may be added alone or in a mixture to the above-mentioned silver halide emulsion.

Such surface active agents may be used as a coating assistant, an emulsifier, a permeability improver for a processing liquid, a defoaming agent, an anti-static agent, an antiadhesive, and a variety of surface active agents for improving photographic characteristics or for controlling physical properties of the emulsion.

In the silver halide color photographic materials of the invention, the constituent layer thereof, such as a protective layer, interlayer, light-sensitive emulsion layer or backing layer, may contain a benzotriazole, triazine, benzophenone compound or an acrylonitrile compound to serve as an ultraviolet ray absorbent. In particular, it is desirable to use Tinuvin Ps, 320,326, 327,328 which are manufactured by Ciba Geigy, and the like, separately or in combination.

Further, with the purpose of improving the stability of the color photograph, it is possible to contain a p-substituted phenol in a light-sensitive emulsion layer and/or the adjacent layers.

The silver halide color photographic materials of the invention are prepared by coating the layers over a support that has excellent flatness and dimensional stability. Such supports are suitably selected according to the purposes of using the photographic materials, and in general, subcoated supports are used in order to strengthen the adhesion thereof to emulsion layers.

The silver halide color photographic materials of the invention include all kinds of color photosensitive materials such as a color negative film, color positive film, color reversal film, color printing paper and the like.

The above-mentioned color photosensitive materials may be developed in a popular color development process. Color developing agents to be used for the above-mentioned color development processes are an aromatic primary amine developer and inter alia, a p-phenylene diamine developing agent is particularly preferable.

As for the photographic additives for the color developing liquids to be used in the above-mentioned color development processes, there may be used an alkaline agent, pH adjuster or buffer, development accelerator, antifoggant, antistaining or antisludging agent, interlayer effect accelerator, preservative, rapid processing additive, or the like.

A color photosensitive material which was color-developed with such color developing liquid is then treated selectively in a series of the conventional photographic processes such as a stopping, stop-fixing, fixing, bleaching, and bleach-fixing processes; a variety of other processes such as a stabilizing, washing, drying process and the like, and thus a color image is obtained.

The invention will be understood more concretely by making reference to the following examples. These examples are intended to illustrate the invention and are not to be construed to limit the scope of the invention.

EXAMPLE 1

Samples 1 through 24 were prepared respectively in such a manner that 20 g of the couplers identified in Table 1 were added to a mixture of 10 ml of tricresyl phosphate and 50 ml of ethyl acetate, and each of the samples of the mixed solution thus obtained were heated up to 60° C. and then completely dissolved. Each of these solutions was mixed with 20 ml of 10% aqueous solution of Alkanol (i.e., alkylnaphthalene sulfonate, mfd. by Du Pont) and 100 ml of 10% aqueous solution of gelatin and then emulsifiably dispersed by a colloid mill. Each of the dispersion solutions thus obtained were added to 1 mol of silver iodobromide emulsion containing 6 mol% of silver iodide and then were added 4-hydroxy-6-methyl-1,3,3a,7-tetrazaindene, saponin, aldehyde scavengers indicated respectively in Table 1 below, and 1,2-bis(vinyl sulfonyl) ethane hardener, and the materials thus obtained were coated over triacetate bases and were then dried.

These samples were exposed to light by an intensity scale type photosensitometer, and then the following processes were applied thereto.

Process 1

Each of the samples was kept at 30° C. for three days in a closed vessel in which a liquid containing 300 cc of aqueous solution 35% glycerol was put on the base of the vessel and the air was filled up in equilibrium with the liquid phase.

Process 2

A liquid comprising 6 cc of aqueous solution of 40% formaldehyde per 300 cc of aqueous solution of 35% glycerol was put on the base of a closed vessel and the air was filled in equilibrium with the liquid phase, and each of the samples was kept in the vessel at 30° C. for three days.

The samples processed in the above-mentioned two processes were color-developed in accordance with the following steps, respectively.

| Color Developing Steps | | |
|---|---|---|
| Steps | Processing Time | |
| Color developing | 3 min. | 15 sec. |
| Bleaching | 6 min. | 30 sec. |
| Washing | 3 | 15 |
| Fixing | 6 | 30 |
| Washing | 3 | 15 |
| Stabilizing | 1 | 30 |

The composition of the processing liquids used in the abovementioned processing steps are as follows:

| | |
|---|---|
| Composition of Color-developing Liquid | |
| 4-amino-3-methyl-N—ethyl-N—(β-hydroxy ethyl)-aniline sulfate | 4.75 g |
| Sodium sulfite, anhydrous | 4.25 g |
| Hydroxy amine-½ sulfate | 2.0 g |
| Potassium carbonate, anhydrous | 37.5 g |
| Sodium bromide | 1.3 g |
| Nitrilacetic acid trisodium salt | 2.5 g |
| Sodium hydroxide | 1.0 g |
| Add water to make | 1000.0 ml |
| Adjust the pH value with potassium hydroxide to pH 10.0 | |
| Composition pf Bleaching Liquid | |
| Iron ethylenediamine tetraacetic acid ammonia salt | 100.0 g |
| Ethylenediamine tetraacetic acid diammonium salt | 10 g |
| Ammonium bromide | 150 g |
| Glacial acetic acid | 10 ml |
| Add water to make | 1000 ml |
| Adjust the pH value with aqueous ammonia to pH 6.0 | |
| Composition of Fixing Liquid | |
| Ammonium thiosulfate (50% aqueous solution) | 152 ml |
| Sodium sulfite, anhydrous | 12.4 g |
| Add water to make | 1000 ml |
| Adjust the pH value with acetic acid to pH 6.5 | |
| Composition of Stabilizing Liquid | |
| Formalin (37% aqueous solution) | 5.0 ml |
| Konidux (mfd. by Konishiroku Photo Ind. Co., Ltd.) | 7.5 ml |
| Add water to make | 1000,0 ml |

Taking the samples which were color-processed in the above steps, the maximum magenta color density thereof were measured respectively in wavelength of 547 nm, and then the measurements were made on the relative lowering of the maximum magenta density caused in each of the samples which were in contact with formaldehyde gas processed in Process-2, in comparison with those of the samples not in contact with formaldehyde gas processed in Process-1. The results are shown in Table 1. In the Table, each of the values of the maximum magenta color density represents the value after subtracting the value of the mask.green density from the value of the maximum green density.

In Table 1, the percentages of the variation indicate the relative values of the maximum magenta density of the samples processed in Process-1 to the values of the maximum magenta density of the samples processed in Process-2. The physical property and the brittleness of the layers were evaluated by the following processes.

Each of the samples was shredded to the size of 1×80 cm, and was then preserved in an atmosphere of 23° C.

and 20% RH, and was thus evaluated for the brittleness by means of a wedge type tester described in P.S.E., vol. 1, p. 63, 1957. The measurement values obtained in the tests are indicated by the lengths in mm of the fracture which occurred in the shredded samples. The longer the length of the fracture, the more brittle is the sample.

TABLE 1

| Sample No. | Magenta Coupler | | Aldehyde Scavenger Kind | | Aldehyde Scavenger Amt. added | Max. magenta density Process −1 | Max. magenta density Process −2 | Variation (%) | Physical property of emulsion brittleness |
|---|---|---|---|---|---|---|---|---|---|
| 1 | Control Coupler | C-1 | — | | — | 2.20 | 1.81 | 37 | 15 cm |
| 2 | Control Coupler | C-2 | — | | — | 2.27 | 0.95 | 42 | 14 cm |
| 3 | Control Coupler | C-3 | — | | — | 2.19 | 0.90 | 41 | 14 cm |
| 4 | Exemplified Coupler | M-1 | — | | — | 2.23 | 0.89 | 40 | 16 cm |
| 5 | Exemplified Coupler | M-18 | — | | — | 2.30 | 0.81 | 35 | 15 cm |
| 6 | Exemplified Coupler | M-24 | — | | — | 2.29 | 0.89 | 39 | 12 cm |
| 7 | Control Coupler | C-1 | Control Scavenger | S-1 | 0.3 g/m$^2$ | 2.22 | 1.15 | 52 | 23 cm |
| 8 | Control Coupler | C-2 | Control Scavenger | S-2 | " | 2.24 | 1.23 | 55 | 27 cm |
| 9 | Control Coupler | C-1 | Control Scavenger | S-3 | 0.3 g/m$^2$ | 2.24 | 1.19 | 53 | 21 cm |
| 10 | Control Coupler | C-1 | Exemplified Compound | (1) | " | 2.23 | 1.27 | 57 | 20 cm |
| 11 | Control Coupler | C-1 | Exemplified Compound | (15) | " | 2.25 | 1.31 | 58 | 24 cm |
| 12 | Control Coupler | C-1 | Exemplified Compound | (22) | " | 2.22 | 1.33 | 60 | 25 cm |
| 13 | Control Coupler | C-1 | Exemplified Compound | (41) | " | 2.24 | 1.28 | 57 | 25 cm |
| 14 | Control Coupler | C-1 | Exemplified Compound | (45) | " | 2.24 | 1.23 | 55 | 30 cm |
| 15 | Exemplified Coupler | M-18 | Control Scavenger | S-1 | " | 2.29 | 1.19 | 52 | 28 cm |
| 16 | Exemplified Coupler | M-18 | Control Scavenger | S-2 | " | 2.28 | 1.23 | 54 | 25 cm |
| 17 | Exemplified Coupler | M-18 | Control Scavenger | S-3 | " | 2.30 | 1.22 | 53 | 24 cm |
| 18 | Exemplified Coupler | M-18 | Exemplified Compound | (1) | " | 2.30 | 2.07 | 90 | 22 cm |
| 19 | Exemplified Coupler | M-18 | Exemplified Compound | (15) | " | 2.27 | 2.22 | 94 | 23 cm |
| 20 | Exemplified Coupler | M-18 | Exemplified Compound | (20) | " | 2.29 | 2.13 | 93 | 25 cm |
| 21 | Exemplified Coupler | M-18 | Exemplified Compound | (41) | " | 2.31 | 2.03 | 88 | 26 cm |
| 22 | Exemplified Coupler | M-18 | Exemplified Compound | (45) | " | 2.29 | 1.95 | 85 | 27 cm |
| 23 | Exemplified Coupler | M-1 | Exemplified Compound | (15) | " | 2.24 | 2.13 | 95 | 21 cm |
| 24 | Exemplified Coupler | M-24 | Exemplified Compound | (15) | " | 2.27 | 2.13 | 94 | 22 cm |
| 25 | Exemplified Coupler | M-18 | Control Scavenger | S-1 | 0.5 g/m$^2$ | 2.27 | 1.59 | 70 | 35 cm |
| 26 | Exemplified Coupler | M-18 | Control Scavenger | S-1 | 0.8 g/m$^2$ | 2.28 | 1.87 | 80 | 54 cm |
| 27 | Exemplified Coupler | M-18 | Control Scavenger | S-1 | 1.3 g/m$^2$ | 2.28 | 2.17 | 95 | 70 cm |
| 28 | Control Coupler | C-1 | Exemplified Compound | (15) | 0.5 g/m$^2$ | 2.23 | 1.69 | 76 | 34 cm |
| 29 | Control Coupler | C-1 | Exemplified Compound | (15) | 0.7 g/m$^2$ | 2.23 | 1.87 | 84 | 45 cm |
| 30 | Control Coupler | C-1 | Exemplified Compound | (15) | 0.9 g/m$^2$ | 2.24 | 2.13 | 95 | 67 cm |

Aldehyde Scavengers for Control

TABLE 1-continued

| Sample No. | Magenta Coupler | Aldehyde Scavenger Kind | Aldehyde Scavenger Amt. added | Max. magenta density Process −1 | Max. magenta density Process −2 | Variation (%) | Physical property of emulsion brittleness |
|---|---|---|---|---|---|---|---|
| S-1 | | S-2 | | | | | |

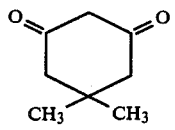

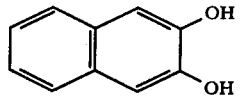

S-3

$H_2N.NH_2$

Coupler for Control; C-1

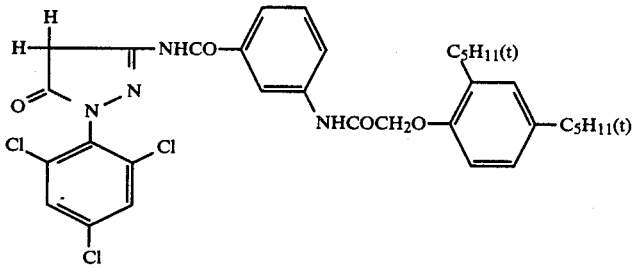

Coupler for Control; C-2

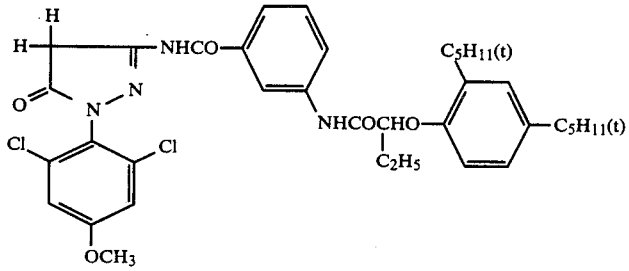

Coupler for Control; C-3

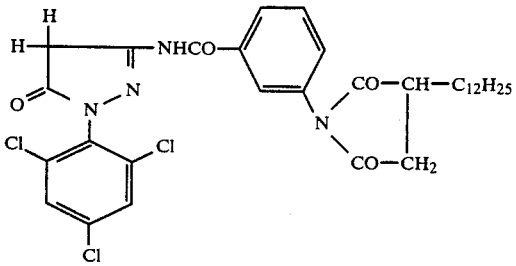

As is obvious from Table 1, in Samples 1 through 6, wherein no aldehyde scavenger was used but the couplers were respectively used independently, there was no significant difference between the couplers relating to the invention and the couplers for control, in the lowering of magenta density caused by the contact with formaldehyde.

On the other hand, in the comparison between the aldehyde scavengers relating to the invention and those for control, there was no significant difference observed in the aldehyde capturing capability thereof, unless they are used in combination with the couplers of this invention.

As is apparent from Samples 18 through 24 of the invention respectively comprising the couplers of the invention and the aldehyde scavengers thereof, the lowering of the magenta density of the samples after processed in Process-2 were very effectively inhibited, and thus it was established that, when compared with the other samples for control, the magenta density, which is produced by specific combination of the couplers and the aldehyde scaventers of the invention, is excellently maintained and a lowered density is prevented.

Further, as may be judged from Samples 25 through 30, it was also found that, if the equivalent to those of the invention are attempted by combining other magenta couplers and other aldehyde scavengers than those of the invention, it is necessary to increase the amount added thereof to the extent that the physical properties of the emulsion are lowered.

Tests were also carried out on the other exemplified compounds such as those of (9), (34), (38) and (43) in place of the aldehyde compounds listed in Table 1 and equivalent results were obtained.

EXAMPLE 2

Over supports respectively comprising a transparent cellulose.triacetate film, the following layers were coated in ascending order from the support side, and thus, multi-layered color negative type photosensitive materials were prepared so that the green-sensitive layers thereof contain the couplers relating to the invention and the couplers for control respectively shown in Table 2.

1st layer: Anti-halation layer

An aqueous gelatin solution containing black colloidal silver was coated on a support to provide silver in an amount of 0.3 g/m$^2$ and a coating thickness when dry of 30μ.

2nd layer: Interlayer

An aqueous gelatin solution was coated on the 1st layer to provide a coating thickness when dry of 1.0μ.

3rd layer: Red-sensitive and relatively lower photosensitive silver halide emulsion layer.

A silver iodobromide emulsion, which was prepared by mixing a silver iodobromide emulsion having the average particle size of 0.6μ and containing 4 mol% of silver iodide with a silver iodobromide emulsion having the average particle size of 0.3μ and containing 4 mol% of silver iodide in the proportion of 2:1 was chemically sensitized with gold and a sulfur-sensitizer. There added thereto red-sensitizing dyes, i.e., anhydrous 9-ethyl-3,3'-di-(3-sulfopropyl)-4,5,4',5'-dibenzothiacarbocyanine hydroxide; anhydrous 5,5'-dichloro-9-ethyl-3,3'-di-(3-sulfobutyl)thiacarbocyanine hydroxide; and anhydrous 2-[2-{(5-chloro-3-ethyl-2(3H)-benzothiazolidene)methyl}-1-butenyl-5-chloro-3-(4-sulfobutyl)benzoxazolium. Then 1.0 g of 4-hydroxy-6-methyl-1,3,3a,7 tetrazaindene and 20.0 mg of 1-phenyl-5-mercaptotetrazole were added therein. Further, the following mixture per mol of silver halide was dissolved by heat: A cyan coupler, i.e., 59 g of 1-hydroxy-N-[δ-(2,4-di-t-amyl-phenoxy)butyl]-2-naphthamide; a colored cyan coupler, i.e., 4 g of 1-hydroxy-4-[4-(1-hydroxy-8-acetamide-3,6-disulfo-2-naphthylazo)phenoxy]-N-[δ-(2,4-di-t-amylphenoxy)butyl]-2-naphthamide disodium salt; a DIR compound, i.e., 1.7 g of 2-(1-phenyl-5-tetrazolylthio)-4-octadecylsuccinimide-1-indanone; 0.5 g of dodecyl gallate; 65 g of tricresyl phosphate and 136 ml of ethyl acetate. Then added into 550 ml of an aqueous solution of 7.5% gelatin containing 5 g of sodium triisopropyl naphthalene sulfonate, and the mixture obtained was emulsifiably dispersed by means of a colloid mill. The dispersed material thus prepared was added in the silver iodobromide emulsion and the mixture obtained was coated on the 2nd layer to provide a coating thickness when dry of 4.0μ. The emulsion contained 160 g of gelatin per mol of silver halide.

4th layer: Red-sensitive and relatively higher photosensitive silver halide emulsion layer A silver iodobromide emulsion having the average particle size of 1.2μ and containing 7 mol% of silver iodide was chemically sensitized with gold and a sulfur-sensitizer. There added thereto red-sensitizing dyes, i.e., anhydrous 9-ethyl-3,3'-di-(3-sulfopropyl)-4,5,4',5'-dibenzothiacarbocyanine hydroxide; anhydrous 5,5'-dichloro-9-ethyl-3,3'-di-(3-sulfobutyl)thiacarbocyanine hydroxide; and anhydrous 2-[2{(5-chloro-3-ethyl-2(3H)-benzothiazolidene)methyl}-1-butenyl-5-chloro-3-(4-sulfobutyl)benzoxazolium, and then 1.0 g of 4-hydroxy-6-methyl-1,3,3a,7 tetrazaindene and 10.0 mg of 1-phenyl-5-mercaptotetrazole were added therein. Further, the following mixture per mole of silver halide was dissolved by heat: A cyan coupler, i.e., 17 g of 1-hydroxy-N-[δ-(2,4-di-t-amylphenoxy)butyl]-2-naphthamide; colored cyan coupler, i.e., 4 g of 1-hydroxy-4-[(1-hydroxy-8-acetamide-3,6-disulfo-2-naphthylazo)-phenoxy]-N-[δ-(2,4-di-t-amylphenoxy)butyl]-2-naphthamide disodium salt; a DIR compound, i.e., 1.6 g of 2-(1-phenyl-5-tetrazolylthio)-4-octadecylsuccinimide-1-indanone; 0.5 g of dodecyl gallate; 20 g of tricresyl phosphate and 60 ml of ethyl acetate. Then added into 30 ml of an aqueous solution of 7.5% gelatin containing 1.5 g of sodium triisopropyl naphthalene sulfonate, and was emulsifiably dispersed by means of a colloid mill. The dispersed material thus prepared was then added in the silver iodobromide emulsion and was coated on the 3rd layer to provide a coating thickness when dry of 2.0μ. The emulsion contained 160 g of gelatin per mol of silver halide.

5th layer: Interlayer

This is the same as the 2nd layer.

6th layer: Green-sensitive and relatively lower photosensitive silver halide emulsion layer Silver iodobromide emulsion having the average particle size of 0.6μ and containing 4 mol% of silver iodide and silver iodobromide emulsion having the average particle size of 0.3μ and containing 7 mol% of silver iodide were chemically sensitized respectively with gold and a sulfur-sensitizer there added green-sensitizing dyes, i.e., anhydrous 5,5'-dichloro-9-ethyl-3,3'-di-(3-sulfobutyl)oxacarbocyanine hydroxide; anhydrous 5,5'-diphenyl-9-ethyl-3,3'-di-(3-sulfobutyl)oxacarbocyanine hydroxide; and anhydrous 9-ethyl-3,3;-di-(3-sulfopropyl)-5,6,5',6',-dibenzoxacarbocyanine hydroxide; and then added 1.0 g of 4-hydroxy-6-methyl-1,3,3a,7 tetrazaindene and 20.0 mg of 1-phenyl-5-mercaptotetrazole; and the preparations were thus made respectively in an ordinary process. The two kinds of the silver halide emulsions thus obtained were mixed together in the proportion of 1:1.

Further, the following mixture per mol of silver halide was dissolved by heat: A colored magenta coupler, i.e., 2.5 g of 1-(2,4,6-trichlorophenyl)-4-(1-naphthylazo)-3-(2-chloro-5-octadecenylsuccinimido anilino)-5-pyrazolone; a DIR compound, i.e., 1.8 g of 2-(1-phenyl-5-tetrazolylthio)-4-octadecyl succinimide-1-indanone; 0.5 g of dodecyl gallate; 120 g of tricresyl phosphate and 240 ml of ethyl acetate. Then added into an aqueous gelatin solution containing sodium triisopropyl naphthalene sulfonate, and was emulsifiably dispersed by means of a colloid mill. The dispersed material thus prepared was then added in the silver iodobromide emulsion to prepare a green-sensitive and relatively lower photosensitive emulsion. The emulsion was coated on the 5th layer to provide a coating thickness when dry of 4.0μ. The emulsion contained 160 g of gelatin per mol of silver halide.

7th layer: Green-sensitive and relatively higher photosensitive silver halide emulsion layer Silver iodobromide emulsion having the average particle size of 1.2μ and containing 7 mol% of silver iodide was chemically sensitized with gold and a sulfur-sensitizer. There added green-sensitizing dyes, i.e., anhydrous 5,5'-dichloro-9-ethyl-3,3'-di-(3-sulfobutyl)oxacarbocyanine hydroxide; anhydrous 5,5'-diphenyl-9-ethyl-3,3'-di-(3-sulfobutyl)oxacarbocyanine hydroxide; and anhydrous 9-ethyl-3,3'-di-(3-sulfopropyl)-5,6,5',6'-dibenzoxacarbocyanine hydroxide; and then added 1.0 g of 4-hydroxy-6-methyl-1,3,3a,7 tetrazaindene and 10.0 mg of 1-phenyl-5-mercaptotetrazole.

Further, the following mixture per mol of silver halide was dissolved by heat: A colored magenta coupler, i.e., 2.5 g of 1-(2,4,6-trichlorophenyl)-4-(1-naphthylazo)-3-(2-chloro-5-octadecenylsuccinimidoanilino)-5-pyrazolone; 120 g of trucresyl phosphate and 240 ml of ethyl acetate. Then added into an aqueous gelatin solution containing sodium triisopropyl naphthalene sulfonate, and was emulsifiably dispersed by means of a colloid mill. The dispersed material thus prepared was then added in the silver iodobromide emulsion to prepare a green-sensitive and relatively higher photosensitive emulsion. The emulsion was coated on the 6th layer to provide a coating thickness when dry of 2.0μ. The emulsion contained 160 g of gelatin per mol of silver halide.

8th layer: Interlayer

This is the same as the 2nd layer.

9th layer: Yellow filter layer

To an aqueous solution of gelatin in which yellow colloidal silver was dispersed, there added a dispersed solution in which 3 g of 2,5-di-t-octylhydroquinone and 1.5 g of di-2-ethylhexyl phthalate were dissolved with 10 ml of ethyl acetate and then the solution dissolved was dispersed in an aqueous gelatin solution containing 0.3 g of sodium triisopropyl naphthalene sulfonate; and the mixture thus obtained was coated on the 8th layer in the proportion of 0.9 g/m$^2$ of gelatin and 0.10 g/m$^2$ of 2,5-di-t-octyl hydroquinone, to provide a coating thickness when dry of 1.2μ.

10th layer: Blue-sensitive and relatively lower photosensitive silver halide emulsion layer Silver iodobromide emulsion having the average particle size of 0.6μ and containing 6 mol% of silver iodide was chemically sensitized with gold and a sulfur-sensitizer, and was added thereinto a sensitizing dye, i.e., anhydrous 5,5'-dimethoxy-3,3'-di-(3-sulfopropyl)-thiacyanine hydroxide. Further, 1.0 g of 4-hydroxy-6-methyl-1,3,3a,7 tetrazaindene and 20.0 ml of 1-phenyl-5-mercaptotetrazole were added, and the preparation was made in an ordinary process. The following mixture per mol of silver halide was dissolved by heat: i.e., 120 g of α-pivaloyl-α-(1-benzyl-2-phenyl-3,5-dioxo-1,2,4-triazolidine-4-yl)-2'-chloro-5'-[α-(dodecyloxycarbonyl-)ethoxycarbonyl]acetanilido and 50 g of α-{3-[α-(2,4-di-t-amylphenoxy)butylamide)}benzoyl-2-methoxyacetanilide; 120 g of dibutyl phthalate and 300 ml of ethyl acetate. Then added in an aqueous gelatin solution containing sodium triisopropylnaphthalene sulfonate and was thus emulsifiably dispersed by means of a colloid mill, and a blue-sensitive and relatively lower photosensitive silver halide emulsion was prepared. Then the emulsion was coated on the 9th layer to provide a coating thickness when dry of 4.0μ. The emulsion contained 160 g of gelatin per mol of silver halide.

11th layer: Blue-sensitive and relatively higher photosensitive silver halide emulsion layer Silver iodobromide emulsion having the average particle size of 1.2μ and containing 7 mol% of silver iodide was chemically sensitized with gold and a sulfur-sensitizer, and a sensitizing dye, i.e., anhydrous 5,5'-dimethoxy-3,3'-di(3-sulfopropyl)thiacyanine hydroxide, was added thereto; and 1.0 g of 4-hydroxy-6-methyl-1,3,3a,7 tetrazaindene and 10.0 mg of 1-phenyl-5-mercaptotetrazole were then added thereto; and the emulsion was prepared in an ordinary process. The following mixture per mole of silver halide was dissolved by heat: A yellow coupler, i.e., 80 g of α-pivaloyl-α-(1-benzyl-2-phenyl-3,5-dioxo-1,2,4-triazolidine-4-yl)-2'-chloro-5'-[α-(dodecyloxy carbonyl)ethoxycarbonyl-]acetanilido; 80 g of dibutyl phthalate and 240 ml of ethyl acetate. Then added in an aqueous gelatin solution containing sodium triisopropylnaphthalene sulfonate and was emulsifiably dispersed by means of a colloid mill, and a blue-sensitive and relatively higher photosensitive silver halide emulsion was prepared. The emulsion was coated on the 10th layer to provide a coating thickness when dry of 2.0μ. The emulsion contained 240 g of gelatin per mol of silver halide.

Dispersion solution was prepared in the manner that 2 g of di-2-ethylhexyl phthalate, 2 g of 2-[3-cyano-3-(n-dodecylaminocarbonyl)allylidene]-1-ethylpyrrolidine and 2 ml of ethylacetate were mixed together and the mixture thus obtained was dispersed in an aqueous gelatin solution containing 0.6 g of sodium triisopropyl naphthalene sulfonate. Thus prepared dispersion solution was coated on the 11th layer in the proportion of 1.0 g/m$^2$ of gelatin to provide a coating thickness when dry of 1.0μ.

13th layer: Protective layer

An aqueous gelatin solution containing 4 g of gelatin and 0.2 g of 1,2-bisvinyl sulfonyl ethane per 100 ml of the solution was coated on the 12th layer in the proportion of 1.3 g of gelatin per m$^2$ to provide a coating thickness when dry of 1.2μ.

Samples 31 through 56 were prepared so that the 6th, 7th, 8th, 9th, 10th and 11th layers of the multi-layered photosensitive materials could contain aldehyde scavengers as shown in Table 2 below. In Table 2, the amount of such scavengers is tabulated as the total amount in all the layers.

To these 26 samples, exposure to light was applied by means of an intensity-scale type photosensitometer and then the two types of preservation processes were applied for five days in the same manner as in Example 1. Thereafter, the respective color development was processed and the maximum magenta density of each sample was measured, and thus, similar to Example 1, the degree of the color density lowering of each sample caused by formaldehyde gas was measured. At the same time, the physical properties of the emulsions, that is, the brittleness thereof, were also tested, in the same manner as Example 1. Also, the measurements were made on the photographic characteristics of the respective blue-sensitive layers of the samples which were applied with the aforementioned Process-1. The results thereof are shown in Table 2 below.

TABLE 2

| Sample No. | Magenta Coupler | | Aldehyde Scavenger Kind | | Aldehyde Scavenger Amt. added | Variation ratio of Formaldehyde processing | Physical property and Brittleness of Emulsion | Photographic characteristics of Blue-sensitive layer Fog | Gamma | Relative Sensitivity |
|---|---|---|---|---|---|---|---|---|---|---|
| 31 | Control Coupler | C-1 | — | | — | 39 | 21 cm | 0.10 | 0.82 | 100 |
| 32 | Control Coupler | C-2 | — | | — | 42 | 20 | 0.11 | 0.81 | 100 |
| 33 | Exemplified Coupler | M-1 | — | | — | 37 | 22 | 0.10 | 0.82 | 100 |
| 34 | Exemplified Coupler | M-18 | — | | — | 37 | 20 | 0.11 | 0.80 | 100 |
| 35 | Exemplified Coupler | M-24 | — | | — | 40 | 21 | 0.11 | 0.81 | 100 |
| 36 | Control Coupler | C-1 | Control Scavenger | S-1 | 0.7 g/m$^2$ | 57 | 53 | 0.12 | 0.79 | 98 |
| 37 | Control Coupler | C-1 | Control Scavenger | S-2 | " | 65 | 52 | 0.12 | 0.79 | 97 |
| 38 | Exemplified Coupler | M-18 | Control Scavenger | S-1 | " | 63 | 50 | 0.12 | 0.79 | 97 |
| 39 | Exemplified Coupler | M-18 | Control Scavenger | S-1 | 1.5 g/m$^2$ | 72 | 70 | 0.15 | 0.75 | 90 |
| 40 | Exemplified Coupler | M-18 | Control Scavenger | S-1 | 2.5 g/m$^2$ | 91 | 78 | 0.18 | 0.70 | 82 |
| 41 | Exemplified Coupler | M-18 | Control Scavenger | S-2 | 1.5 g/m$^2$ | 78 | 68 | 0.16 | 0.73 | 91 |
| 42 | Control Coupler | C-1 | Exemplified Compound | (15) | 0.7 g/m$^2$ | 69 | 51 | 0.12 | 0.79 | 98 |
| 43 | Control Coupler | C-1 | Exemplified Compound | (15) | 1.5 g/m$^2$ | 80 | 67 | 0.15 | 0.74 | 92 |
| 44 | Control Coupler | C-1 | Exemplified Compound | (15) | 2.5 g/m$^2$ | 90 | 77 | 0.17 | 0.69 | 85 |
| 45 | Control Coupler | C-1 | Exemplified Compound | (44) | 0.7 g/m$^2$ | 70 | 52 | 0.12 | 0.78 | 97 |
| 46 | Control Coupler | C-1 | Exemplified Compound | (48) | " | 71 | 54 | 0.13 | 0.79 | 98 |
| 47 | Exemplified Coupler | M-18 | Exemplified Compound | (1) | 0.5 g/m$^2$ | 95 | 30 | 0.11 | 0.80 | 100 |
| 48 | Exemplified Coupler | M-18 | Exemplified Compound | (15) | " | 93 | 28 | 0.11 | 0.80 | 100 |
| 49 | Exemplified Coupler | M-18 | Exemplified Compound | (41) | " | 90 | 24 | 0.11 | 0.80 | 100 |
| 50 | Exemplified Coupler | M-18 | Exemplified Compound | (45) | " | 90 | 31 | 0.11 | 0.80 | 100 |
| 51 | Exemplified Coupler | M-24 | Exemplified Compound | (1) | " | 97 | 24 | 0.11 | 0.81 | 100 |
| 52 | Exemplified Coupler | M-24 | Exemplified Compound | (15) | " | 94 | 21 | 0.11 | 0.81 | 100 |
| 53 | Exemplified Coupler | M-24 | Exemplified Compound | (41) | " | 91 | 23 | 0.11 | 0.81 | 100 |
| 54 | Exemplified Coupler | M-24 | Exemplified Compound | (45) | " | 89 | 29 | 0.11 | 0.81 | 100 |
| 55 | Exemplified Coupler | M-18 M-24 | Exemplified Compound | (15) | " | 98 | 26 | 0.11 | 0.81 | 100 |
| 56 | Exemplified Coupler | M-18 M-24 | Exemplified Compound | (1) (15) | " | 96 | 24 | 0.11 | 0.80 | 100 |

As is clear from Table 2, similar to the case of Example 1, in the samples 47 through 56 prepared in accordance with the invention, it was found that the magenta color density lowering prevention effect obtained through the formaldehyde processing was particularly superior to those of the samples prepared in other processes than those of the invention. It was also clarified that the physical properties of the emulsions or the photograhic characteristics of the blue-sensitive layers of the samples of the invention were also superior to others.

Among those, samples 55 and 56 were prepared by making combination use of both couplers and the aldehyde scavengers relating to the invention, and whereby it was proved that there was no difference between two samples in the working effect obtained by the invention.

EXAMPLE 3

Among the samples of Example 2, Samples 31, 34, 36, 38, 39, 40, 42, 43, 44, 47, 48, 49 and 50 were processed in aldehyde processes-1 and -2 respectively, in the same manner as Example 2, and were put to the heat resistance and wet resistance tests at 40° C. and 80% of RH for 10 days, and were then color-developed. There measured the maximum magenta density of each sample and the degree of the magenta density lowering in each sample caused by the formaldehyde treatment, heat resistance treatment and wet resistance treatment.

The results thereof are shown in Table 3 below.

TABLE 3

| Sample No. | Max. Magenta Denisty Process-1 | Process-2 | Variation Ratio |
|---|---|---|---|
| 31 | 2.11 | 0.53 | 25 |
| 34 | 2.13 | 0.64 | 30 |
| 36 | 2.11 | 0.87 | 41 |
| 38 | 2.15 | 0.88 | 41 |
| 39 | 2.15 | 0.86 | 40 |
| 40 | 2.14 | 1.26 | 59 |
| 42 | 2.12 | 0.74 | 35 |
| 43 | 2.11 | 1.03 | 49 |
| 44 | 2.12 | 1.12 | 53 |
| 47 | 2.13 | 1.77 | 83 |
| 48 | 2.15 | 1.76 | 82 |
| 49 | 2.11 | 1.50 | 71 |
| 50 | 2.16 | 1.60 | 74 |

As is clear from Table 3 above, it was found that all of Samples 47 through 50 prepared through the invention were superior to the samples outside the invention in the maximum magenta density lowering prevention effect, even when such processes as mentioned above were applied thereto.

EXAMPLE 4

With respect to eight samples prepared in Example 1 and nine samples in Example 2 as tabulated in Table 4 below, the exposures to light were made thereon and the color development processes were applied thereto, respectively. The results thereof are shown in Table 4, wherein the values of ΔFog indicated in process variation-1 represent the raised values of fog observed when the pH values of the color-developers were adjusted to 10.5 in developing, and the values of ΔFog in process variation-2 represent the raised values of Fog observed when the color-developing temperature was adjusted to 43° C.

TABLE 4

| Sample No. | Process Variation-1 ΔFog | Process Variation-2 ΔFog |
|---|---|---|
| 1 | 0.15 | 0.16 |
| 5 | 0.17 | 0.16 |
| 7 | 0.14 | 0.14 |
| 11 | 0.13 | 0.13 |
| 15 | 0.16 | 0.15 |
| 18 | 0.06 | 0.05 |
| 19 | 0.05 | 0.06 |
| 20 | 0.05 | 0.06 |
| 21 | 0.08 | 0.09 |
| 22 | 0.09 | 0.09 |
| 31 | 0.10 | 0.11 |
| 34 | 0.07 | 0.08 |
| 36 | 0.10 | 0.10 |
| 38 | 0.08 | 0.07 |
| 42 | 0.10 | 0.09 |
| 47 | 0.02 | 0.03 |
| 48 | 0.03 | 0.03 |
| 49 | 0.05 | 0.05 |
| 50 | 0.05 | 0.05 |
| 51 | 0.02 | 0.03 |
| 52 | 0.02 | 0.03 |
| 53 | 0.05 | 0.04 |
| 54 | 0.04 | 0.05 |

As is apparent from Table 4 above, as far as the single-layered samples of Example 1 are concerned, it was found in Samples 18 through 22 of the invention that the fog was also effectively prohibited from increasing in a color developing process under the conditions of a high pH value and high temperature.

Among the aldehyde scavengers used in the samples of the invention, the scavengers formulized in the aforegiven Formulas [IIA] and [IIB] were found particularly effective. Among the samples used in Example 2, the samples 47 through 54 of the invention were also found excellent in the anti-fogging effect under the abovementioned processing conditions, similarly to the case as described above.

We claim:

1. A multi-layer light-sensitive silver halide color photographic material, comprising:

(i) a support, and (ii) a magenta coupler containing layer on said support, said magenta coupler having the following formula I:

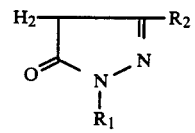

I wherein, $R_1$ represents an aryl group or a heterocyclic group; and $R_2$ represents a benzamide group, an anilino group or a phenylureido group which contains an

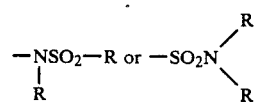

group wherein R represents a hydrogen atom, an alkyl group, an aryl group, an alkoxy group, an amino group or a heterocyclic group;

wherein at least one layer selected from the group consisting of (1) said magenta coupler containing layer, and (2) at least one layer on said magenta coupler containing layer positioned in the direction away from said support, contains at least one compound of the following formulas IIA, IIB, IIC or IID:

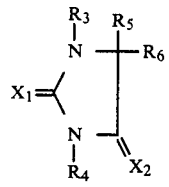

IIA wherein $X_1$ and $X_2$ each represent oxygen or an imino group; $R_3$ and $R_4$ each represent hydrogen, an acyl group or an alkyl group; and $R_5$ and $R_6$ each represent hydrogen, a hydroxyl group, an amino group, a ureido group, an alkyl group, an aryl group, an aryloxy group, an alkoxy group, and $R_5$ and $R_6$ can be coupled to produce a 5–6 membered saturated carbocyclic nucleus;

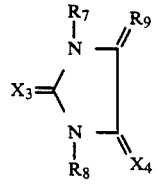

IIB wherein, $X_3$ and $X_4$ each represent oxygen or an imino group; $R_7$ and $R_8$ each represent hydrogen, an acyl group or an alkyl group; and $R_9$ represents an imino group or an alkylidene group;

IIC

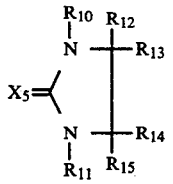

wherein $X_5$ represents oxygen or an imino group; $R_{10}$ and $R_{11}$ each represent hydrogen, an acyl group or an alkyl group; and $R_{12}$, $R_{13}$, $R_{14}$ and $R_{15}$ each represent hydrogen, a hydroxy group, an amino group, an alkyl group, an alkoxy group, an aryl group, an aryloxy group, a ureido group, and $R_{12}$ and $R_{13}$ or $R_{14}$ and $R_{15}$ can be coupled to produce 5-6 membered saturated carbocyclic nucleus; and

IID

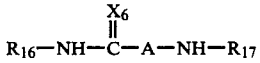

wherein $X_6$ represents oxygen; $R_{16}$ and $R_{17}$ each represent hydrogen or an alkyl group; and A represents —NH$(CH_2)_m$—NHCO— or —NHCO— in which the terminal nitrogen atom couples to the carbon atom bonded to the $X_6$ group and m is 1 or 2.

2. The color photographic material of claim 1, wherein said compound has the formula IIA, and (i) said acyl group is an alkylcarbonyl, (ii) said alkyl groups, and (iii) said alkoxy groups, contain from 1 to 5 carbon atoms.

3. The color photographic material of claim 1, wherein said compound has the formula IIA, and (i) $R_5$ and $R_6$ are coupled and (ii) form cyclopentyl or cyclohexyl.

4. The color photographic material of claim 1, 2 or 3, wherein $X_1$ and $X_2$ are oxygen.

5. The color photographic material of claim 1, 2 or 3, wherein $R_3$ and $R_4$ are hydrogen.

6. The color photographic material of claim 4, wherein $R_3$ and $R_4$ are hydrogen.

7. The color photographic material of claim 1, 2 or 3, wherein $R_5$ and $R_6$ are each hydrogen or ureido.

8. The color photographic material of claim 6, wherein $R_5$ and $R_6$ are each hydrogen or ureido.

9. The color photographic material of claim 1, wherein said compound has the formula IIB and, (i) said acyl group is an alkylcarbonyl, and (ii) said alkyl groups, contain from 1 to 5 carbon atoms.

10. The color photographic material of claim 1 or 9, wherein $R_7$ and $R_8$ are hydrogen.

11. The color photographic material of claim 1, wherein said compound has the formula IIC and, (i) said acyl group is an alkylcarbonyl, (ii) said alkyl groups, and (iii) said alkoxy groups, contain from 1 to 5 carbon atoms.

12. The color photographic material of claim 1, wherein said compound has the formula IIC and said aryl group is phenyl.

13. The color photographic material of claim 1, wherein said compound has the formula IIC and said aryloxy group is phenoxy.

14. The color photographic material of claim 1, wherein said compound has the formula IIC and said 5-6 membered saturated carbocyclic nucleus is cyclopentyl or cyclohexyl.

15. The color photographic material of claim 1, wherein said compound has the formula IID and said alkyl group contains from 1 to 5 carbon atoms.

16. The color photographic material of claim 1 wherein said magenta coupler has the following formula IIIA or IIIB:

IIIA

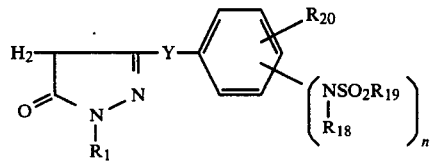

IIIB

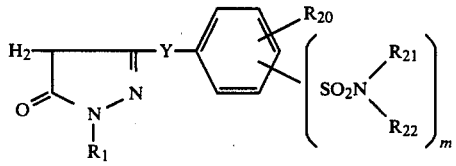

wherein Y represents —NHCO— group, —NH— group or —NHCONH— group; and $R_{18}$, $R_{21}$ and $R_{22}$ each represent hydrogen, an alkyl, aryl, or heterocyclic group having from 1 to 18 carbon atoms; $R_{19}$ represents an alkyl or aryl group having from 1 to 18 carbon atoms, an alkoxy group having from 1 to 18 carbon atoms, an amino group; $R_{20}$ represents hydrogen, halogen, or an alkoxy group having from 1 to 4 carbon atoms; and n and m represent 1 or 2, respectively.

17. The color photographic material of claim 16, wherein $R_1$ is a phenyl group, a pyridyl group, a quinolyl group, a furyl group, a benzothiazolyl group, an oxazolyl group, an imidazolyl group or a naphthoxazolyl group.

18. The color photographic material of claim 16, wherein $R_1$ is phenyl substituted with a halogen atom, an alkyl group having 1 to 4 carbon atoms or an alkoxy group having 1 to 4 carbon atoms.

19. The color photographic material of claim 16, wherein said heterocyclic group in $R_{18}$, $R_{21}$ or $R_{22}$ is a pyridyl group, a quinolyl group, a furyl group, a benzothiazolyl group, an oxazolyl group, an imidazolyl group or a naphthoxazolyl group.

20. The color photographic material of claim 16, wherein said aryl group in $R_{18}$, $R_{19}$, $R_{21}$ or $R_{22}$ is a phenyl group.

21. The color photographic material of claim 20, wherein said phenyl group is phenyl substituted with an alkoxy group having 1 to 18 carbon atoms, an amido having 1 to 18 carbon atoms or an alkyl group having 1 to 18 carbon atoms.

22. The color photographic material of claim 16, wherein Y is —NHCO— group and $R_{20}$ is hydrogen.

23. The color photographic material of claim 20, wherein Y is —NH— group and $R_{20}$ is halogen or an alkoxy group.

24. The color photographic material of claim 16, wherein said compound is at least one compound of the formula IIA or IIB.

25. The color photographic material of claim 1, wherein said at least one compound of the formula IIA, IIB, IIC or IID is contained in at least one layer on said magenta coupler containing layer selected from a light-sensitive silver halide emulsion layer, an intermediate layer, an ultra-violet absorbing layer, a yellow filter layer, and a protective layer.

26. The color photographic material of claim 25, wherein said protective layer contains said compound having the formulas IIA, IIB, IIC, or IID.

27. The color photographic material of claim 1, wherein said compound having the formula IIA, IIB, IIC, or IID is added in an amount of about 0.1 to 5 g per sq meter of said color photographic material.

28. The color photographic material of claim 27, wherein said compound is added in an amount of 0.1 to 2 g.

29. The color photographic material of claim 1 or 28, wherein said magenta coupler containing layer comprises a silver halide and said magenta coupler is added in an amount of $5\times10^{-3}$ to 5 mol per mol of said silver halide.

30. The color photographic material of claim 29, wherein said amount is $1\times10^{-2}$ to 1 mol.

31. The color photographic material of claim 28, wherein said amount is $1\times10^{-2}$ to 1 mol.

32. The color photographic material of claim 30, wherein said at least one compound is a compound selected from the formulae IIA, IIB or IIC and $R_3$, $R_4$, $R_7$, $R_8$, $R_{10}$ and $R_{11}$ are hydrogen.

33. The color photographic material of claim 1, wherein said at least one compound is a compound of the formula IIC and $R_{10}$ and $R_{11}$ are hydrogen.

34. The color photographic material of claim 1, wherein said magenta coupler is a compound selected from the group consisting of

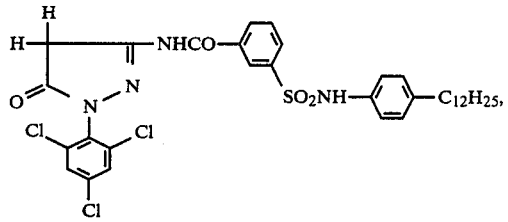

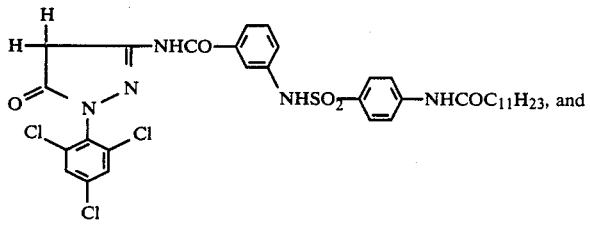

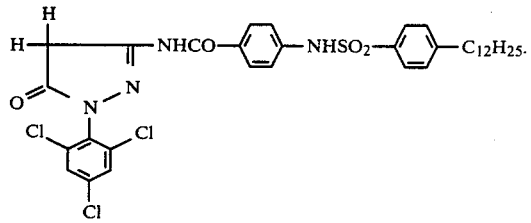

35. The color photographic material of claim 1, wherein said at least one compound is the following compound of the formula IIA

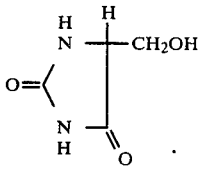

* * * * *